US006183115B1

(12) United States Patent
Durando

(10) Patent No.: US 6,183,115 B1
(45) Date of Patent: Feb. 6, 2001

(54) IMAGE PROJECTING LAMPSHADE

(76) Inventor: Ronald A. Durando, 107 Rhoda Ave., Nutley, NJ (US) 07110

( * ) Notice: Under 35 U.S.C. 154(b), the term of this patent shall be extended for 0 days.

(21) Appl. No.: 09/309,852

(22) Filed: May 11, 1999

(51) Int. Cl.[7] ..... F21V 11/00

(52) U.S. Cl. ..... 362/351; 362/356; 362/358; 362/410; 40/554

(58) Field of Search ..... 362/351, 352, 362/356, 358, 410, 414, 806, 313, 314, 361; 40/366, 367, 554

(56) References Cited

U.S. PATENT DOCUMENTS 4,285,028 * 8/1981 Sundin et al. ..... 362/35
4,994,946 * 2/1991 NakaMata ..... 362/282
6,004,010 * 12/1999 Inage et al. ..... 362/294

* cited by examiner

*Primary Examiner*—Sandra O'Shea
*Assistant Examiner*—John Anthony Ward
(74) *Attorney, Agent, or Firm*—Perman & Green, LLP

(57) ABSTRACT

A specially constructed lampshade contains a simple projection system mounted in operative association with the light bulb of a lamp on which the shade is mounted.

10 Claims, 1 Drawing Sheet

IMAGE PROJECTING LAMPSHADE

BACKGROUND OF THE INVENTION

In today's hectic world of constant activity and instantaneous entertainment, parents face an age old problem with increasing difficulty, namely, getting their children to settle down for sleep. Going to sleep is continuously avoided while the parents patience are tried to the extreme. It is the purpose of this invention, to provide a device for projecting images on the ceiling of a child's bedroom using the bed side lamp as a source of light. A lampshade is used as the housing for the projector.

The prior art, for example, U.S. Pat. Nos. 4,163,998 and 2,974,435 shows the use of a lampshade to illuminate a photo or other image using the lamp as a source of light, but there is no projection. There are many special purpose projectors for example the signs described in U.S. Pat. Nos. 1,656,110 and 940,281, or the lamps of U.S. Pat. Nos. 5,517,264 and 4,858,079 but none of these use a lampshade for projecting images as does the invention of this application.

The prior art projectors are cumbersome and expensive and in general will not provide a lamp which can also be used as originally intended, namely to illuminate a room. It is the purpose of this invention to provide a lampshade suitable for use on any standard lamp used at the bedside of a child which is constructed with a projection system mounted within to allow images to be shown on the ceiling. A simple and inexpensive device is described which can be conveniently used to interest the child in a restful manner to bridge the transition from an active day to a peaceful and sleep filled night.

SUMMARY OF THE INVENTION

A specially constructed lampshade contains a simple projection system mounted in operative association with the light bulb of a lamp on which the shade is mounted. The projection system consists of a lens mounted on a frame along the axis of the lampshade so that light from the bulb will be focused on the ceiling. A slide or other suitable image bearing medium is placed on a second frame in relative position with the lens to create an image which will be focused by the lens on the ceiling. Appropriate cooling means are provided to increase the ventilating air flow through the lampshade.

DESCRIPTION OF THE DRAWING

The preferred embodiment of the invention is described in more detail below with reference to the attached drawing in which.

DETAILED DESCRIPTION OF THE PREFERRED EMBODIMENT

Figure 1:
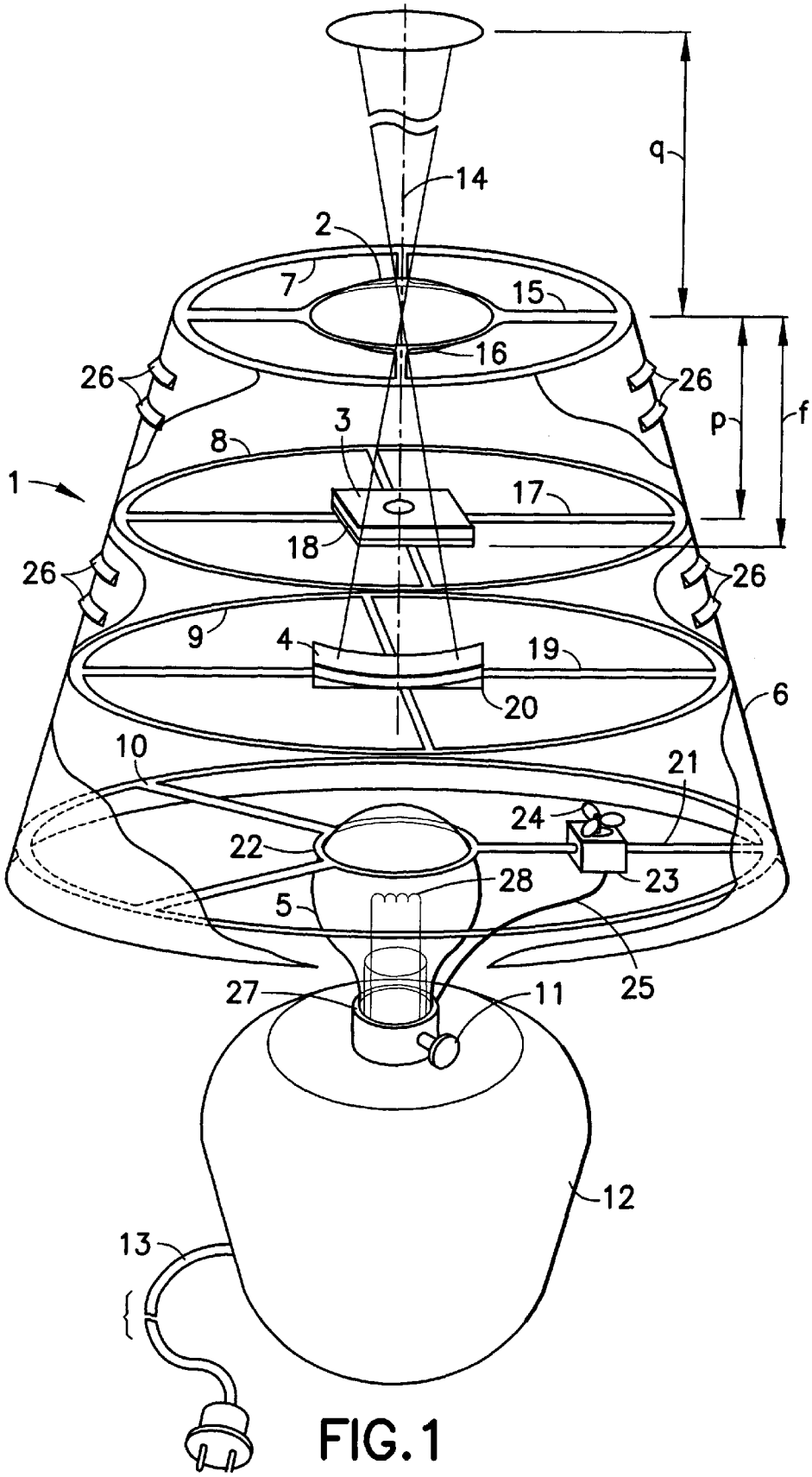
FIGURE 1 is a perspective view of the lampshade partially cut away to show the mechanism of this invention mounted on a lamp.

The lampshade 1 of this invention is shown in FIGURE 1 in which the main body or shell 6 of the shade 1 has been cut away to expose the interior. The lampshade 1 is designed to surround the light of a lamp and screen the ambient surroundings from direct exposure to the light. It has a longitudinal axis 14 which in FIGURE 1 is shown to be substantially vertical. A projection system, consisting of a projection lens 2, a slide 3, and a condensing lens 4, is mounted within the shade body 6 to receive light from the bulb 5. The principal axis of the projection system is aligned with the axis 14 of the lampshade.

Lens 2 is mounted with its principal axis aligned with the axis of the lampshade body 6 on a frame 7. The frame 7 may be constructed of wire and is attached to shade body 6 by tape or other suitable means which will hold the lens in secure position relative to the other components of the projection system. Frame 7 includes a ring with spokes 15 extending radially inward to a bracket 16. The bracket 16 forms a receptacle for the lens 2. Lens 2 is selected to provide a focused image approximately 5 to 6 feet from the top of the lens and the image will be generally enlarged from a slide of approximately 1 inch to an image of perhaps 2 feet. The standard lens formula of $1/f=1/p+1/q$ in which f is the focal length of the lens, p is the distance of the slide to the lens, and q is the distance of the projected image to the lens. Since the magnification of the lens is equal to ratio of the size of the projected image to the actual image and q/p, these relationships can be used to select an appropriate lens. For example: if the ratio of the images in feet is 2.0/0.1 or 20, and the distance q to the image on the ceiling is 6 feet, than p will equal 0.3 feet. With this information, using the lens formula and solving it for f, the focal length of an appropriate lens will be 0.286 feet.

The slide 3 is mounted on its own bracket 18 which is supported by spokes 17 extending radially inward from a second frame 8. The bracket is designed to secure the image in place at a distance p from the lens 3. As can be observed from the above relationships, it is important to position the slide to obtain a projected image of a desirable size. The bracket 18 must be constructed to allow the slide to be easily removed and replaced to provide a variety of images.

A condensing lens 4 may not be necessary, but generally it is advantageous in order to provide an even distribution of the light across the image. Its position relative to the lens is not as sensitive to the overall projection performance of the system. If needed, it is positioned between the light bulb 5 and the slide 3.

The lampshade 1 is mounted on a lamp 12 which is connected to a power supply through a standard cord 13. A switch 11 will energize the filament 28 of lamp 5 to generate light. The body 6 of shade 1 is constructed with a mounting ring 10 having spokes 21 that support a ring 22 which fits the contour of bulb 5 to support the lampshade 1 in the standard manner. When energized, the bulb 5 will also generate significant heat, which must be dissipated to protect the slides or other image media 3. To accomplish this, vents 26 are formed in the lampshade body 6 at critical locations about the periphery of body 6 to increase circulation. In addition a blower may be mounted within the shade 1 consisting of a motor 23 and impeller 24. The motor may be connected by a cord 25 through an accessory outlet (not shown) installed in the socket 27 of the lamp 12 or directly to a wall outlet.

In this manner a simple and inexpensive source of quiet entertainment is provided, which will ease the transition of a child into the bedtime mode and help the parent obtain the necessary cooperation. The lampshade of this invention is readily adaptable to a variety of shapes and sizes and can be moved from lamp to lamp. A new and unique lampshade is provided.

I claim:

1. A lampshade for use with a lamp having a bulb to provide light in the normal operation thereof to illuminate a room having walls and a ceiling, said lampshade comprising:

A hollow shell having a longitudinal axis and an interior which is open at the top and bottom, said shell constructed to surround the bulb to shade the ambient surroundings from receiving light directly therefrom;

mounting means secured to said interior of said shell for supporting the lampshade on the lamp;

a visual medium, having an image thereon, mounted on said interior of the shell above the bulb to allow light from the bulb to be transmitted through said medium; and projecting means mounted on said interior of said shell above the visual medium to receive light transmitted through said medium and project said image of said visual medium on the ceiling.

2. A lampshade for use with a lamp having a bulb to provide light in the normal operation thereof to illuminate a room having walls and a ceiling, as described in claim 1, wherein the projecting means is a lens having a focal length and magnification selected to project said image from the visual medium on the ceiling of the room.

3. A lampshade for use with a lamp having a bulb to provide light in the normal operation thereof to illuminate a room having walls and a ceiling, as described in claim 1, further comprising means to increase the circulation of air through the interior of the shell to prevent destructive overheating of the visual medium.

4. A lampshade for use with a lamp having a bulb to provide light in the normal operation thereof to illuminate a room having walls and a ceiling, as described in claim 3, wherein the circulating means comprises an electrically driven blower.

5. A lampshade for use with a lamp having a bulb to provide light in the normal operation thereof to illuminate a room having walls and a ceiling, as described in claim 3, wherein the circulating means comprises a plurality of vents constructed in the shell.

6. A lampshade for use with a lamp having a bulb to provide light in the normal operation thereof to illuminate a room having walls and a ceiling, as described in claim 2, wherein the projecting means further comprises a condensing lens mounted on said interior of said shell between the bulb and the visual medium to collect the light from the bulb and distribute said light evenly across said image of said visual medium.

7. A lampshade for use with a lamp having a bulb to provide light in the normal operation thereof to illuminate a room having walls and a ceiling, as described in claim 1, wherein the visual medium comprises a slide transparency.

8. A lampshade for use with a lamp having a bulb to provide light in the normal operation thereof to illuminate a room having walls and a ceiling, said lampshade comprising:

A hollow shell having a longitudinal axis and an interior which is open at the top and bottom, said shell constructed to surround the bulb to shade the ambient surroundings from receiving light directly therefrom;

mounting means secured to the interior of said shell for supporting the lampshade on the lamp;

a visual medium, having an image thereon, mounted on said interior of said shell above the bulb to allow light from the bulb to be transmitted through said medium; and a projecting system mounted on said interior of said shell above the visual medium to receive light transmitted through said medium said system comprising a lens having a focal length and magnification selected to project the image from the visual medium on the ceiling of the room.

9. A lampshade for use with a lamp having a bulb to provide light in the normal operation thereof to illuminate a room having walls and a ceiling, as described in claim 8, wherein the projecting means further comprises a condensing lens mounted on said interior of said shell between the bulb and the visual medium to collect the light from the bulb and distribute said light evenly across said image of said visual medium.

10. A lampshade for use with a lamp having a bulb to provide light in the normal operation thereof to illuminate a room having walls and a ceiling, as described in claim 9, wherein the visual medium is a slide transparency and the projecting lens, the condensing lens, and the slide are mounted on the longitudinal axis of the shell.

* * * * *